US005318398A

United States Patent [19]

Kojima

[11] Patent Number: 5,318,398

[45] Date of Patent: Jun. 7, 1994

[54] BOOK DELIVERY DEVICE FOR BOOK BINDING MACHINE

[75] Inventor: Nobuyuki Kojima, Kyoto, Japan

[73] Assignee: Horizon International Inc., Shiga, Japan

[21] Appl. No.: 67,681

[22] Filed: May 26, 1993

[30] Foreign Application Priority Data

May 27, 1992 [JP] Japan ..... 4-180270

[51] Int. Cl.[5] ..... B42B 2/02

[52] U.S. Cl. ..... 412/18; 412/25; 412/33

[58] Field of Search ..... 412/9, 18, 25, 33

[56] References Cited

U.S. PATENT DOCUMENTS 4,681,500 7/1987 Rathert et al. ..... 412/33
5,087,163 2/1992 Erdbories et al. ..... 412/33 X
5,174,556 12/1992 Taylor et al. ..... 412/33 X

FOREIGN PATENT DOCUMENTS 407044 2/1966 Switzerland ..... B42C 11/04
2236074 3/1991 United Kingdom ..... B42C 11/04

*Primary Examiner*—Timothy V. Eley
*Assistant Examiner*—Willmon Fridie, Jr.
*Attorney, Agent, or Firm*—Morgan & Finnegan

[57] ABSTRACT

A delivery device for a book binding machine is provided with a first conveyor belt (19) arranged for movement in a vertical direction between a book delivery station and a book transfer station and a second conveyor belt (40) located in a fixed position so as to be on the same level as the first conveyor belt (19) and in alignment with the first conveyor belt (19) at the book transfer station. The first conveyor belt (19) receives a book block (12) from an clamp (11) at the book delivery station and lowers to the book transfer station so as to transfer the book block to the second conveyor belt (40), then returns to the book delivery station in order to receive the book block from the following clamp.

4 Claims, 3 Drawing Sheets

BOOK DELIVERY DEVICE FOR BOOK BINDING MACHINE

BACKGROUND OF THE INVENTION

This invention relates to a book delivery device for a book binding machine.

In a conventional book binding machine, a number of clamps are successively moved on a book production line. And each of clamps is adapted for movement between a first position in which it clampingly holds a book block and a second position in which it releases the book block from clamping. While the clamps clampingly holding the book blocks are travelling on the book production line, the book blocks are applied with covers at glued spines thereof, then the spines are pressed, and finally when the clamps reach a book delivery station, the clamps move from the first position to the second position so that the book blocks are fallen from the clamps. Thus there is provided a book delivery device for receiving the book blocks fallen from the clamps and transporting it to the next processing station.

At this time, it is necessary to receive the book blocks from the clamps without giving strong impulse to the book blocks because, immediately after glue is applied to the spine, an adhesion between the spine and the cover is not perfect so that the cover may be detached from the spine. Therefore there has been provided a conveyor belt easily sloping downward from the book delivery station so as to receive the book blocks fallen from the clamps. Then the book blocks are transported from the clamps to the conveyor and slowly conveyed by the conveyor belt.

However, this book delivery mechanism inevitably leads to a large-sized book binding machine because there is required space whose length corresponds to a few clamps in order to deliver the book blocks.

SUMMARY OF THE INVENTION

Therefore it is an object of the invention to economize space required for book delivery operation.

It is another object of the invention to provide a compact book binding machine.

According to the present invention there is provided a book delivery device for a book binding machine wherein a number of clamping means are successively moved one by one on a book production line, each of said clamping means being movable between a first position in which said clamping means clampingly holds a book block and a second position in which said clamping means releases said book block from clamping, said book delivery device being adapted for delivering the book blocks from the clamping means clampingly holding said book block at a book delivery station on said book production line, said book delivery device comprising: first conveyor means having a conveyor belt, said first conveyor means being movable in a vertical direction between said book delivery station and a book transfer station positioned beneath said book delivery station, said first conveyor means receiving the book block from said each clamping means at said book delivery station when said each clamping means moves from said first position to said second position; second conveyor means having a conveyor belt, said second conveyor means being located in a fixed position so as to be on the same level as said first conveyor means and in alignment with said first conveyor means at said book transfer station so that said book block is transferred from said first conveyor means to said second conveyor means.

According to a preferred embodiment of the invention, the book delivery device further comprises: a pair of flaps joined to both sides of said first conveyor means for swing movement with respect to proximal ends thereof between an opened position in which said pair of flaps horizontally fall down and a closed position in which said pair of flaps uprightly stand up; means for actuating said pair of flaps in such a manner that said pair of flaps swing from said closed position to said opened position during upward movement of said first conveyor means in order to receive an unfolded cover attached to said book block at said book delivery station and said pair of flaps move from said opened position to said closed position during downward movement of said first conveyor means in order to fold said cover.

According to another embodiment of the invention, said conveyor belts of said first and second conveyor means move in the same direction as that of the movement of said clamping means.

According to further embodiment of the invention, said first conveyor means moves slightly faster than said clamping means and said second conveyor means moves faster than said first conveyor means.

The first conveyor means is lowered synchronously with the movement of the clamping means from the first position to the second position, so that the book block falls on the conveyor belt of the first conveyor means with no strong impulse upon the book block. The book block is received and conveyed on the conveyor belt of the first conveyor means during downward movement of the first conveyor means, consequently the book block is downwardly translated in a slanting direction with respect to the travelling direction of the clamps.

When the first conveyor means reach the book transfer station, the book block is advanced so that a front end portion thereof is placed on the conveyor belt of the second conveyor means, whereby the book block is conveyed by the second conveyor means.

In the case that the second conveyor means moves slightly faster than the first conveyor means, the book block is quickly transferred from the first conveyor means to the second conveyor means and little impulse is affected upon the book block.

According to this construction, it is possible to deliver the book block utilizing only space which corresponds to at most two clamps. In addition, no strong impulse is affected to the book blocks upon receiving them from the clamps though such shorter delivery path is utilized.

BRIEF DESCRIPTION OF DRAWINGS

The other objects and features of this invention will become understood from the following description with reference to the accompanying drawings in which.

DETAILED DESCRIPTION OF THE PREFERRED EMBODIMENTS

Figure 1:
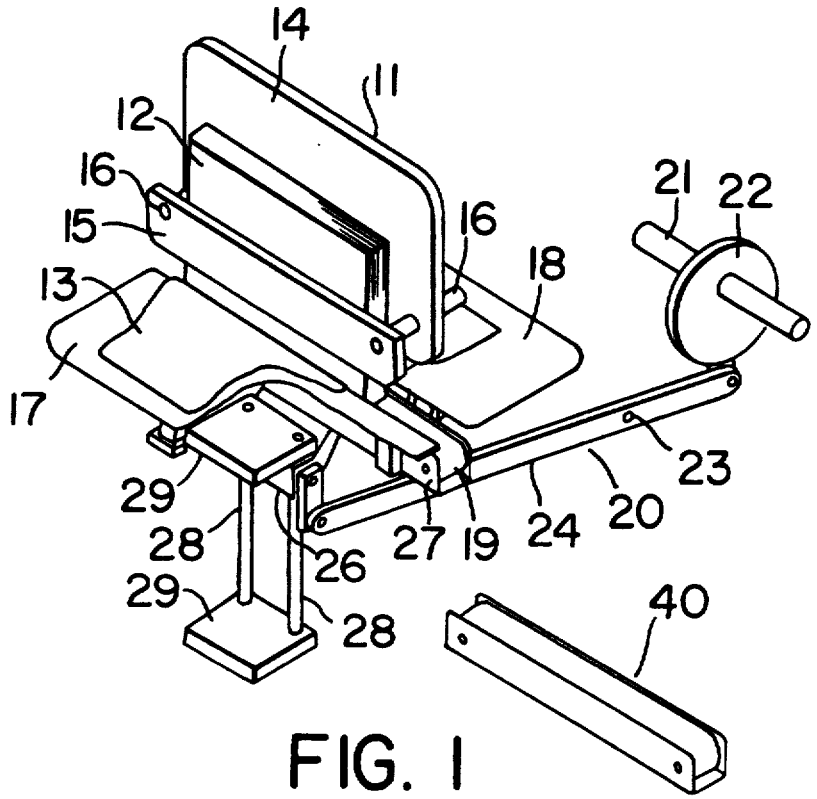
FIG. 1 is a partial cutaway perspective view of a book delivery device for a book binding machine according to the invention, in which a first conveyor belt is positioned in a book delivery station.
Figure 2:
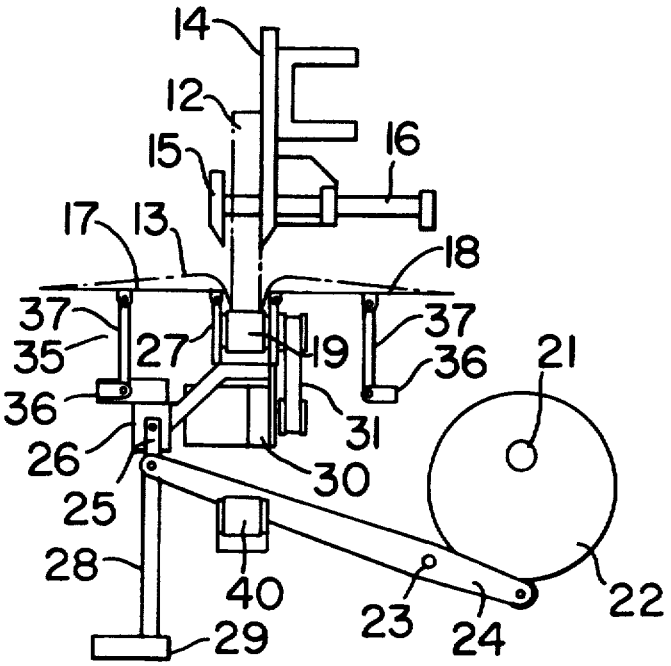
FIG. 2 is a side view of the book delivery device shown in FIG. 1.
Figure 5:
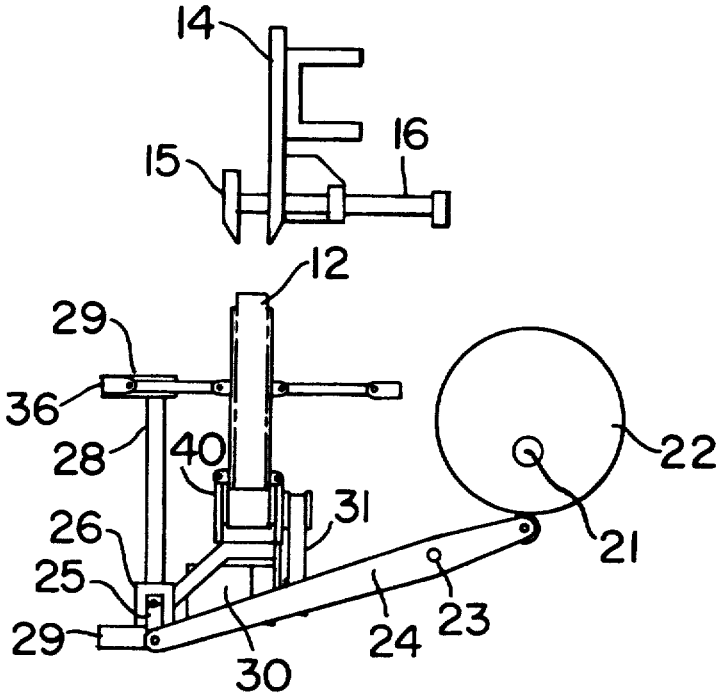
FIG. 5 is a side view of the book delivery device shown in FIG. 4.
Figure 3:
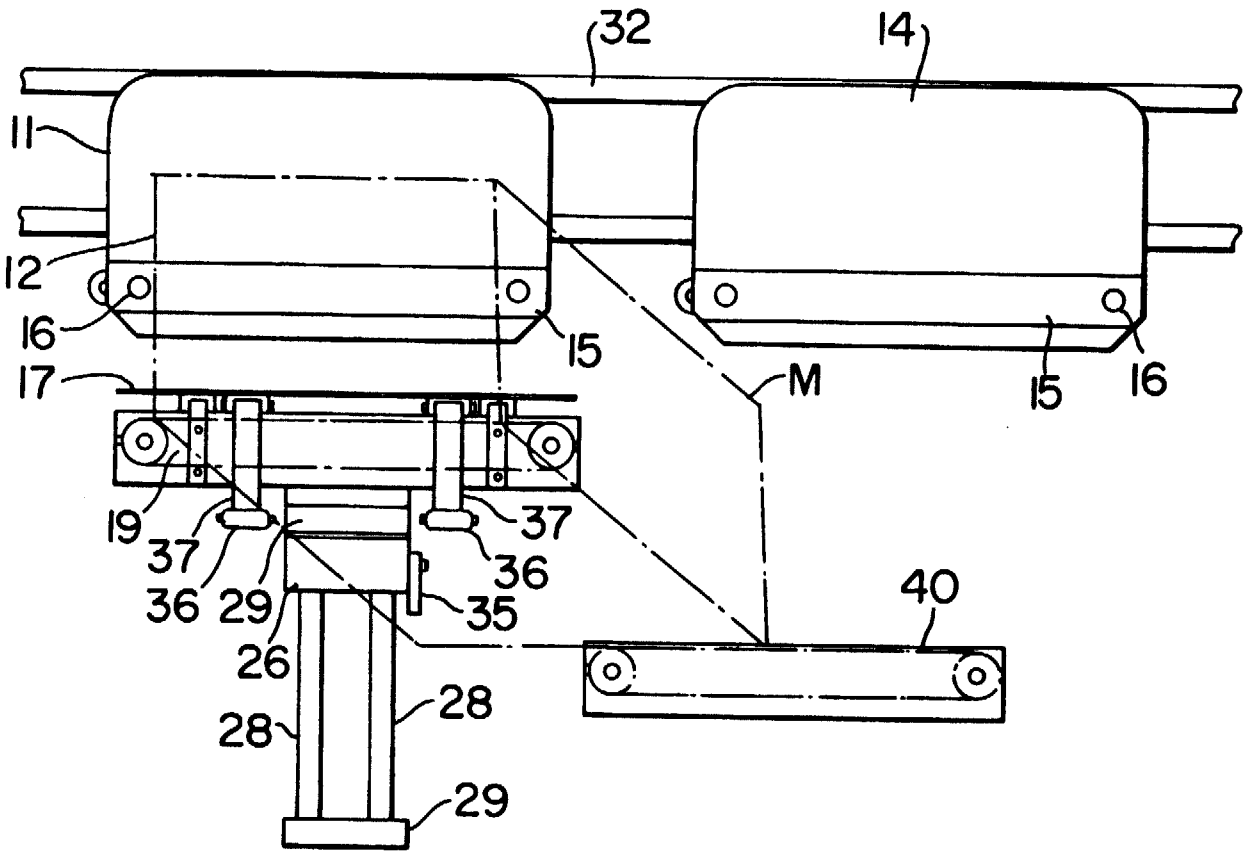
FIG. 3 is an enlarged front view of the book delivery device shown in FIG. 1.

FIGS. 1-3 illustrate a situation at book delivery station on a book production line on which a number of clamps (11) are successively moved one by one. At a processing step prior to an arrival at the book delivery station, a book block (12) clampingly held by the clamp (11) is applied with a cover (13) at a glued spine thereof. At the book delivery station, the cover (13) is not folded so that it is not clamped by the clamp (11).

The clamp (11) comprises a stationary clamp part (14), a guide rods (16), (16) extending perpendicular to the stationary clamp part (14) and a movable clamp part (15) guided by the guide rods (16), (16) for sliding movement. Thus, with the slide movement of the movable clamp part (15), the clamp (11) is movable between a first position in which it clampingly holds the book block (12) between the stationary and movable clamp parts and a second position in which it releases the book block (12) from clamping.

Figure 4:
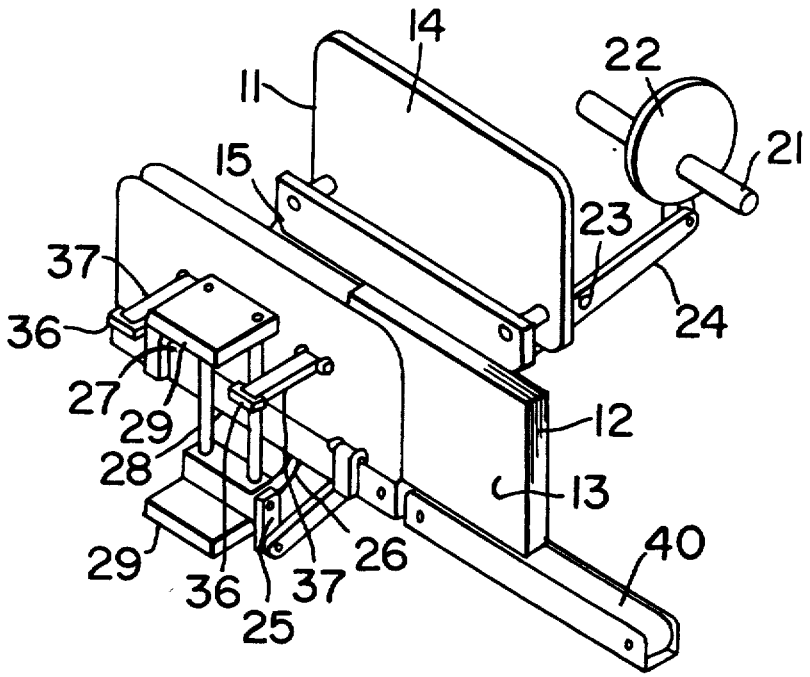
FIG. 4 is a similar perspective view to FIG. 1 showing the book delivery device, in which a first conveyor belt is positioned in a book transfer station.

A first conveyor belt (19) is arranged for vertical movement between the book delivery station on the book production line and a book transfer station positioned beneath the book delivery station. FIG. 1 illustrates the first conveyor belt (19) at the book delivery station, while FIG. 4 illustrates the first conveyor belt (19) at the book transfer station. In addition, the first conveyor belt (19) is arranged opposedly to the spine of the book block (12) at the book delivery station so as to receive the book block (12) from the clamp (11) when the clamp moves from the first position to the second position.

A second conveyor belt (40) is located in a fixed position so as to be on the same level as the first conveyor belt (19) and in alignment with the first conveyor belt (19) at the book transfer station so that the book block (12) is transferred from the first conveyor belt (19) to the second conveyor belt (40).

The first conveyor belt (19) is lifted and lowered by an elevating mechanism (20). The elevating mechanism (20) comprises a cam (22) mounted on a drive shaft (21) extending in a direction parallel with the length of the first conveyor belt (19) and rotated by an appropriate driving source about its axis, and an arm (24) arranged for swing about a support (23). One end of the arm (24) is engaged with the periphery of the cam (22), while the other end is joined to a sliding table (26) through a link (25).

The sliding table (26) is connected with a base frame (27) supporting the first conveyor belt (19). The sliding table (26) is guided by guide shafts (28), (28) for sliding movement in a vertical direction. The guide shafts (28), (28) extend between a pair of base blocks (29), (29) forming part of a machine frame.

The first conveyor belt (19) is constantly moved by a motor (30) fixed to the base frame (27), an endless belt (31) extended between a drive shaft of the first conveyor belt (19) and the motor (30) in the same direction as that of the movement of the clamp (11). The second conveyor belt (40) is also constantly moved by an appropriate drive mechanism (not shown) in the same direction as that of the movement of the clamp (11). Furthermore, the first conveyor belt (19) is moved slightly faster than the clamp (11) and the second conveyor belt (40) is moved slightly faster than the first conveyor belt (19).

A pair of flaps (17), (18) are joined to both sides of the base frame (27) for swing movement about proximal ends thereof between a closed position in which the flaps (17), (18) uprightly stand up and an opened position in which the flaps (17), (18) horizontally fall down. A flap actuating mechanism (35) is arranged for actuating the pair of flaps (17), (18) swing from the closed position to the opened position during upward movement of the first conveyor belt (19) in order to receive an unfolded cover attached to the book block and the pair of flaps (17), (18) swing from the opened position to the closed position during downward movement of the first conveyor belt (19) in order to fold the cover.

The flap actuating mechanism (35) comprises support members (36) pivotally carried on the machine frame and links (37) connecting the rear of the flaps (17), (18) with the support members (36).

When the clamp (11) clamping the book block (12) reaches the book delivery station, the clamp (11) moves from the first position to the second position by the movable clamp part (15) sliding away from the stationary clamp part (14). At the same time the drive shaft (21) starts rotating and the arm (24) is swung counterclockwise through the cam (22), so that the first conveyor belt (19) is lowered. Thus the book block (12) released from clamping falls down on the first conveyor belt (19) with no strong impulse.

The book block (12) is lowered and conveyed on the first conveyor belt (19) during downward movement of the first conveyor belt (19). Namely, the book block (12) is translated downwardly in a slanting direction with respect to the travelling direction of the clamps (11). In FIG. 3, a line M represents a trajectory of such movement of the book block (12). The numeral (32) designates a moving trajectory of the clamp (11).

As the first conveyor belt (19) is lowered, the flaps (17), (18) is pulled down at the proximal ends thereof to swing about the support of the support members (36) from the opened position to the closed position. FIGS. 4 and S illustrate an operating station in which the first conveyor belt (19) is positioned in the book transfer station and the flaps (17), (18) is positioned in the closed position.

The second conveyor belt (40) is arranged in alignment with the first conveyor belt (19) in such a manner that the the book block (12) can be smoothly transferred between the first and second conveyor belts. The second conveyor belt (40) is driven slightly faster than the first conveyor belt (19).

When the first conveyor belt (19) reaches the book transfer station, the book block (12) with the cover is advanced in such a manner that its front end portion is placed on the second conveyor belt (40). Then the book block (12) is transferred from the first conveyor belt (19) to the second conveyor belt (40) and conveyed by the second conveyor belt (40). During this operation, the cam (22) performs one half rotation.

After the book block is conveyed out from the first conveyor belt (19), the arm (24) is swung clockwise by the following one half rotation of the cam (22) and the first conveyor belt (19) is lifted to the book delivery station in order to receive a book block from the following clamp. At this time the cam (22) completes one cycle of the rotation. The cam (22) is temporarily stopped rotating upon the first conveyor belt (19) reaching the book delivery station and stopped rotating during the transferring operation of the book block between the first and second conveyor belts upon the first conveyor belt reaching the book transfer station.

According to the present invention, it is possible to deliver book blocks from clamps in shorter distance than that required for conventional book delivery devices using a slanting conveyor belt. In addition, there is no strong impulse to the book blocks on receiving them from the clamps though such shorter delivery path is utilized.

In the embodiment previously described, book blocks are delivered from clamps while the clamps are continuously moving on the book production line. However, instead of this, it is possible to deliver book blocks from clamps while the clamps are intermittently moved on the book production line. It is also possible to deliver book blocks from clamps in a construction in which the clamps inverse their travelling direction at a book delivery station.

Accordingly, the present invention is advantageous in that it is possible to economize space required for book delivery operation, which leads a compact book binding machine.

We claim:

1. A book delivery device for a book binding machine wherein a number of clamping means are successively moved one by one on a book production line, each of said clamping means being movable between a first position in which said clamping means clampingly holds a book block and a second position in which said clamping means releases said book block from clamping, said book delivery device being adapted for delivering the book blocks from the clamping means clampingly holding said book block at a book delivery station on said book production line, said book delivery device comprising:

first conveyor means having a conveyor belt, said first conveyor means being movable in a vertical direction between said book delivery station and a book transfer station positioned beneath said book delivery station, said first conveyor means receiving the book block from said each clamping means at said book delivery station when said each clamping means moves from said first position to said second position;

second conveyor means having a conveyor belt, said second conveyor means being located in a fixed position so as to be on the same level as said first conveyor means and in alignment with said first conveyor means at said book transfer station so that said book block is transferred from said first conveyor means to said second conveyor means.

2. A book delivery device for a book binding machine according to claim 1, further comprising:

a pair of flaps joined to both sides of said first conveyor means for swing movement with respect to proximal ends thereof between an opened position in which said pair of flaps horizontally fall down and a closed position in which said pair of flaps uprightly stand up;

means for actuating said pair of flaps in such a manner that said pair of flaps swing from said closed position to said opened position during upward movement of said first conveyor means in order to receive an unfolded cover attached to said book block at said book delivery station and said pair of flaps move from said opened position to said closed position during downward movement of said first conveyor means in order to fold said cover.

3. A book delivery device for a book binding machine according to claim 1 or claim 2, wherein said conveyor belts of said first and second conveyor means move in the same direction as that of the movement of said clamping means.

4. A book delivery device for a book binding machine according to claim 3, wherein said first conveyor means moves slightly faster than said clamping means and said second conveyor means moves faster than said first conveyor means.

* * * * *